US009988853B2

(12) United States Patent
Cariveau et al.

(10) Patent No.: US 9,988,853 B2
(45) Date of Patent: Jun. 5, 2018

(54) RETENTION OF MULTIPLE ROLLING CUTTERS

(71) Applicant: Smith International, Inc., Houston, TX (US)

(72) Inventors: Peter T. Cariveau, Spring, TX (US); Yuri Burhan, Spring, TX (US); Yuelin Shen, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days. days.

(21) Appl. No.: 15/378,436

(22) Filed: Dec. 14, 2016

(65) Prior Publication Data

US 2017/0089144 A1 Mar. 30, 2017

Related U.S. Application Data

(63) Continuation of application No. 14/369,531, filed as application No. PCT/US2012/071705 on Dec. 27, 2012, now abandoned.

(60) Provisional application No. 61/581,799, filed on Dec. 30, 2011.

(51) Int. Cl.
*E21B 10/42* (2006.01)
*E21B 10/567* (2006.01)

(52) U.S. Cl.
CPC ..... *E21B 10/42* (2013.01); *E21B 10/567* (2013.01)

(58) Field of Classification Search
CPC ..... E21B 10/43; E21B 10/55; E21B 10/56; E21B 10/573; E21B 10/5735
See application file for complete search history.

(56) References Cited

U.S. PATENT DOCUMENTS

| | | | | |
|---|---|---|---|---|
| 2,951,683 | A | 9/1960 | Tilden | |
| 4,104,344 | A | 8/1978 | Pope et al. | |
| 4,288,248 | A | 9/1981 | Bovenkerk et al. | |
| 5,007,493 | A | 4/1991 | Coolidge et al. | |
| 5,127,923 | A | 7/1992 | Bunting et al. | |
| 5,465,800 | A | 11/1995 | Pearce et al. | |
| 7,703,559 | B2 | 4/2010 | Shen et al. | |
| 8,997,899 | B2 | 4/2015 | Stowe, II | |
| 9,291,000 | B2 | 3/2016 | Zhang et al. | |
| 2006/0150777 | A1 | 7/2006 | Sherwood et al. | |
| 2007/0199739 | A1* | 8/2007 | Schwefe | E21B 10/573 175/426 |
| 2008/0017419 | A1 | 1/2008 | Cooley et al. | |
| 2008/0135297 | A1 | 6/2008 | Gavia | |
| 2008/0308321 | A1* | 12/2008 | Aliko | E21B 10/42 175/431 |

(Continued)

FOREIGN PATENT DOCUMENTS

| | | | |
|---|---|---|---|
| CN | 101622421 | A | 1/2010 |
| CN | 101899952 | A | 12/2010 |
| CN | 102216553 | A | 10/2011 |

OTHER PUBLICATIONS

International Search Report and Written Opinion issued in PCT/US2012/071705 dated Apr. 23, 2013, 15 pages.

(Continued)

*Primary Examiner* — Shane Bomar

(57) ABSTRACT

A cutting tool may include a tool body. At least one blade extends radially from the tool body, and cutters are coupled to the at least one blade. At least one retention component contributes to the retention of at least two of the plurality of cutters.

16 Claims, 8 Drawing Sheets

(56) References Cited

U.S. PATENT DOCUMENTS

| | | | |
|---|---|---|---|
| 2010/0108403 | A1 | 5/2010 | Keshavan |
| 2011/0048811 | A1 | 3/2011 | Hall et al. |
| 2011/0284293 | A1 | 11/2011 | Shen et al. |
| 2014/0326516 | A1 | 11/2014 | Haugvaldstad et al. |
| 2014/0374169 | A1 | 12/2014 | Cariveau et al. |
| 2015/0191979 | A1 | 7/2015 | Jain et al. |

OTHER PUBLICATIONS

First Office Action issued in Chinese Patent Application No. 201280070972.7 dated Aug. 26, 2015; 13 pages.
Second Office Action issued in Chinese Patent Application No. 201280070972.7 dated Mar. 14, 2016; 6 pages.
Notice of Grant issued in related CN application 201280070972.7 dated Aug. 30, 2016, 8 pages.

* cited by examiner

RETENTION OF MULTIPLE ROLLING CUTTERS

CROSS-REFERENCE TO RELATED APPLICATIONS

This application is a continuation of U.S. patent application Ser. No. 14/369,531, which entered the national stage under 35 U.S.C. § 371 on Jun. 27, 2014 from International Application No. PCT/US2012/071705 filed on Dec. 27, 2012, which international application claims the benefit of and priority to U.S. Patent Application No. 61/581,799, filed on Dec. 30, 2011. Each of the foregoing applications is incorporated herein by this reference in its entirety.

BACKGROUND

Various types and shapes of earth boring bits are used in various applications in the earth drilling industry. Earth boring bits have bit bodies which include various features such as a core, blades, and cutter pockets that extend into the bit body or roller cones mounted on a bit body, for example. Depending on the application/formation to be drilled, the appropriate type of drill bit may be selected based on the cutting action type for the bit and its appropriateness for use in the particular formation.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material forming the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are typically bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In a typical application, a compact of polycrystalline diamond (PCD) (or other ultrahard material) is bonded to a substrate material, which is typically a sintered metal-carbide to form a cutting structure. PCD comprises a polycrystalline mass of diamonds (typically synthetic) that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

A PDC cutter is conventionally formed by placing a sintered carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn integrally bonded to the substrate. The substrate often comprises a metal-carbide composite material, such as tungsten carbide-cobalt. The deposited diamond layer is often referred to as the "diamond table" or "abrasive layer."

An example of a prior art PDC bit having a plurality of cutters with ultra hard working surfaces is shown in FIGS. 1A and 1B. The drill bit 100 includes a bit body 110 having a threaded upper pin end 111 and a cutting end 115. The cutting end 115 typically includes a plurality of ribs or blades 120 arranged about the rotational axis L (also referred to as the longitudinal or central axis) of the drill bit and extending radially outward from the bit body 110. Cutting elements, or cutters, 150 are embedded in the blades 120 at predetermined angular orientations and radial locations relative to a working surface and with a desired back rake angle and side rake angle against a formation to be drilled.

A plurality of orifices 116 are positioned on the bit body 110 in the areas between the blades 120, which may be referred to as "gaps" or "fluid courses." The orifices 116 are commonly adapted to accept nozzles. The orifices 116 allow drilling fluid to be discharged through the bit in selected directions and at selected rates of flow between the blades 120 for lubricating and cooling the drill bit 100, the blades 120 and the cutters 150. The drilling fluid also cleans and removes the cuttings as the drill bit 100 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel past the drill bit 100 toward the surface of a wellbore (not shown).

Referring to FIG. 1B, a top view of a prior art PDC bit is shown. The cutting face 118 of the bit shown includes six blades 120. Each blade includes a plurality of cutting elements or cutters generally disposed radially from the center of cutting face 118 to generally form rows. Certain cutters, although at differing axial positions, may occupy radial positions that are in similar radial position to other cutters on other blades.

Cutters are conventionally attached to a drill bit or other downhole tool by a brazing process. In the brazing process, a braze material is positioned between the cutter and the cutter pocket. The material is melted and, upon subsequent solidification, bonds (attaches) the cutter in the cutter pocket. Selection of braze materials depends on their respective melting temperatures, to avoid excessive thermal exposure (and thermal damage) to the diamond layer prior to the bit (and cutter) even being used in a drilling operation.

Specifically, alloys suitable for brazing cutting elements with diamond layers thereon have been limited to only a couple of alloys which offer low enough brazing temperatures to avoid damage to the diamond layer and high enough braze strength to retain cutting elements on drill bits.

A significant factor in determining the longevity of PDC cutters is the exposure of the cutter to heat. Conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

Exposure to heat (through brazing or through frictional heat generated from the contact of the cutter with the formation) can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. As a cutting element contacts the formation, a wear flat develops and frictional heat is induced. As the cutting element continues to be used, the wear flat will increase in size and further induce frictional heat. The heat may build-up that may cause failure of the cutting element due to thermal mismatch between diamond and catalyst discussed above. This is particularly true for cutters that are immovably attached to the drill bit, as conventional in the art.

Accordingly, there exists a continuing need to develop ways to extend the life of a cutting element.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting tool that includes a tool body; at least one blade extending radially from the tool body; a plurality of cutters disposed on the at least one blade; and at least one retention component, each retention component contributing the retention of at least two of the plurality of cutters at a side surface thereof.

In another aspect, embodiments disclosed herein relate to a cutter assembly that includes: a rolling cutter cartridge having at least two cutter cavities formed therein; at least two rotatable cutting elements having a groove formed in a side surface thereof disposed within the at least two cutter cavities, the at least two cutter cavities interfacing the grooves in the at least two rotatable cutting elements; wherein the at least two cavities and at least two rotatable cutters are spaced such that less than 0.1 inch (2.54 mm) is spaced between the at least two rotatable cutters.

In yet another aspect, embodiments disclosed herein relate to a downhole cutting tool, that includes: a cutting element support structure having at least one cutter assembly pocket formed therein; at least one cutter assembly disposed in the at least one cutter assembly pocket, the at least one cutter assembly including: a rolling cutter cartridge having at least two cutter cavities formed therein; and at least two rotatable cutting element disposed within the at least two cavities; and at least one retention mechanism retaining the at least two rotatable cutters in the rolling cutter cartridge.

Other aspects and advantages of the claimed subject matter will be apparent from the following description and the appended claims.

DETAILED DESCRIPTION

In one aspect, embodiments disclosed herein relate to multiple polycrystalline diamond compact cutters being retained on a drill bit or other cutting tool by a mechanism that interfaces the cutter along a side surface thereof such that retention component contributes to the retention of multiple cutters.

Figure 1A:
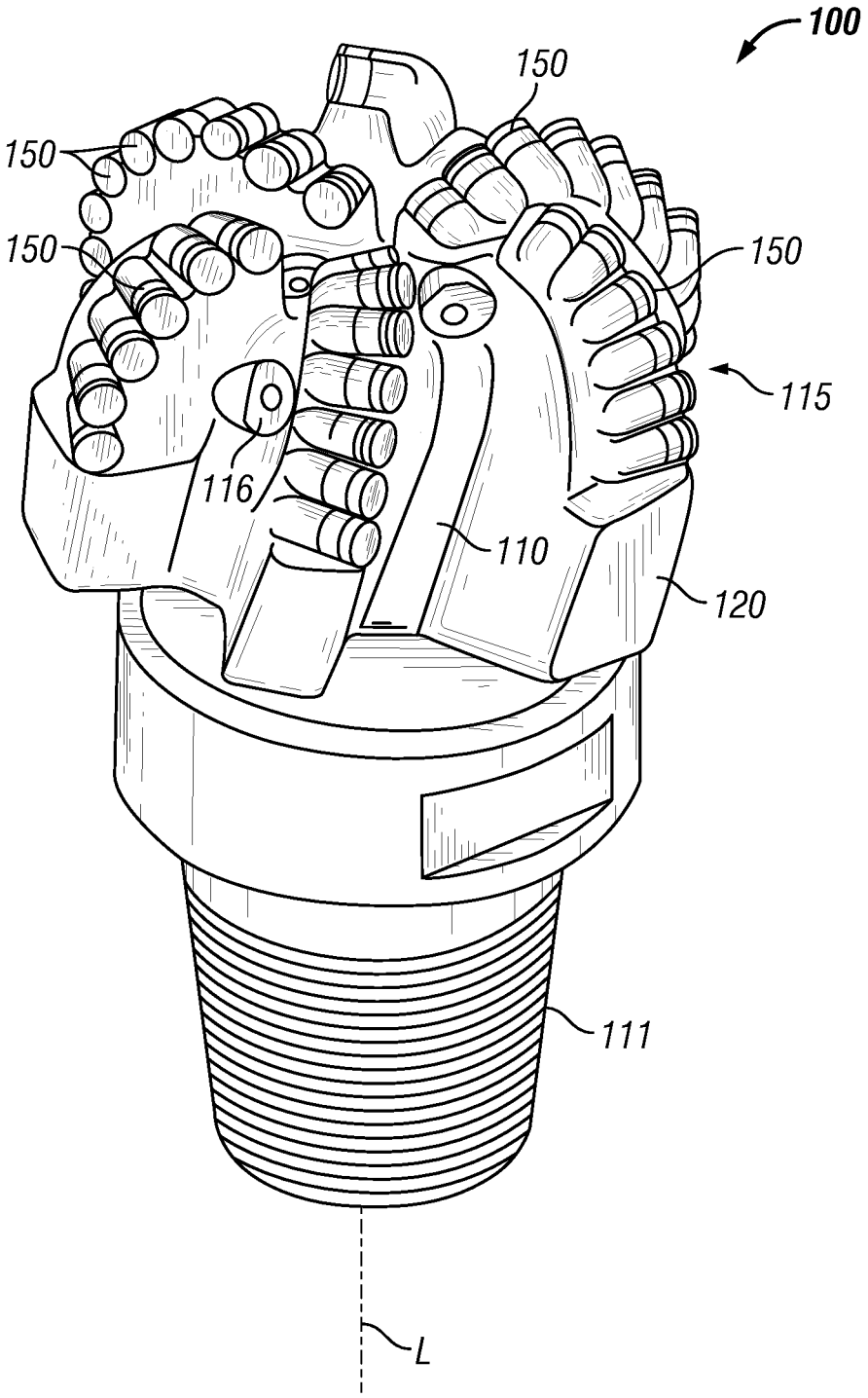
FIG. 1A (Prior Art)
FIGS. 1A and 1B show a side and top view of a conventional drag bit.
Figure 1B:
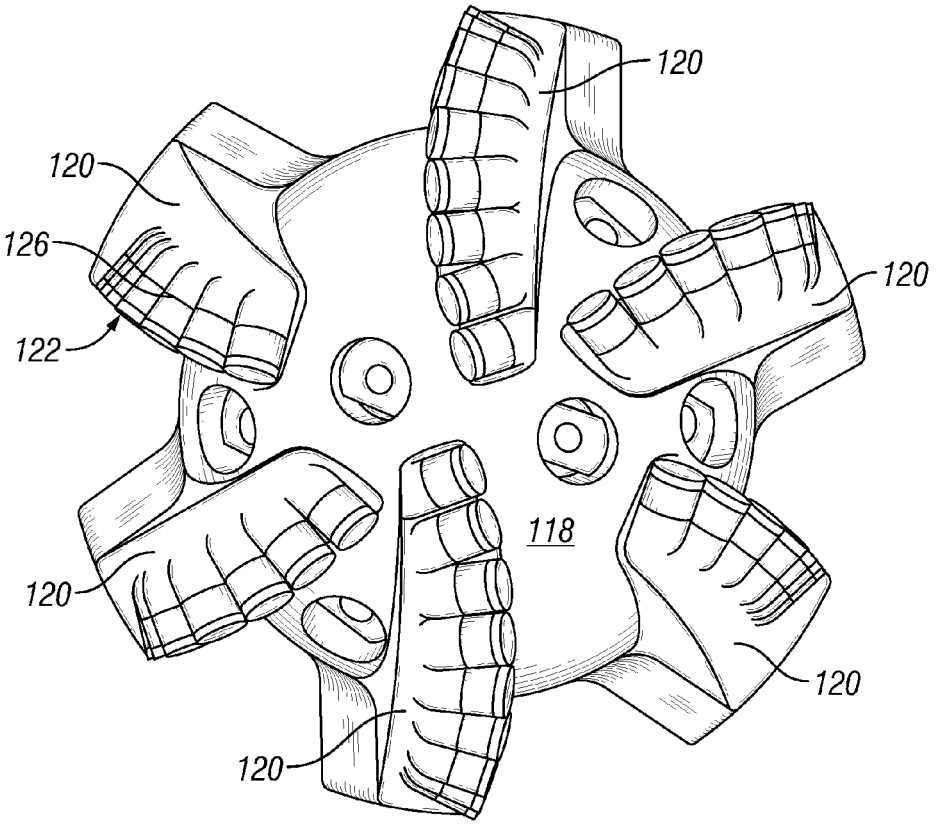
FIG. 1B (Prior Art)
Figure 2A:
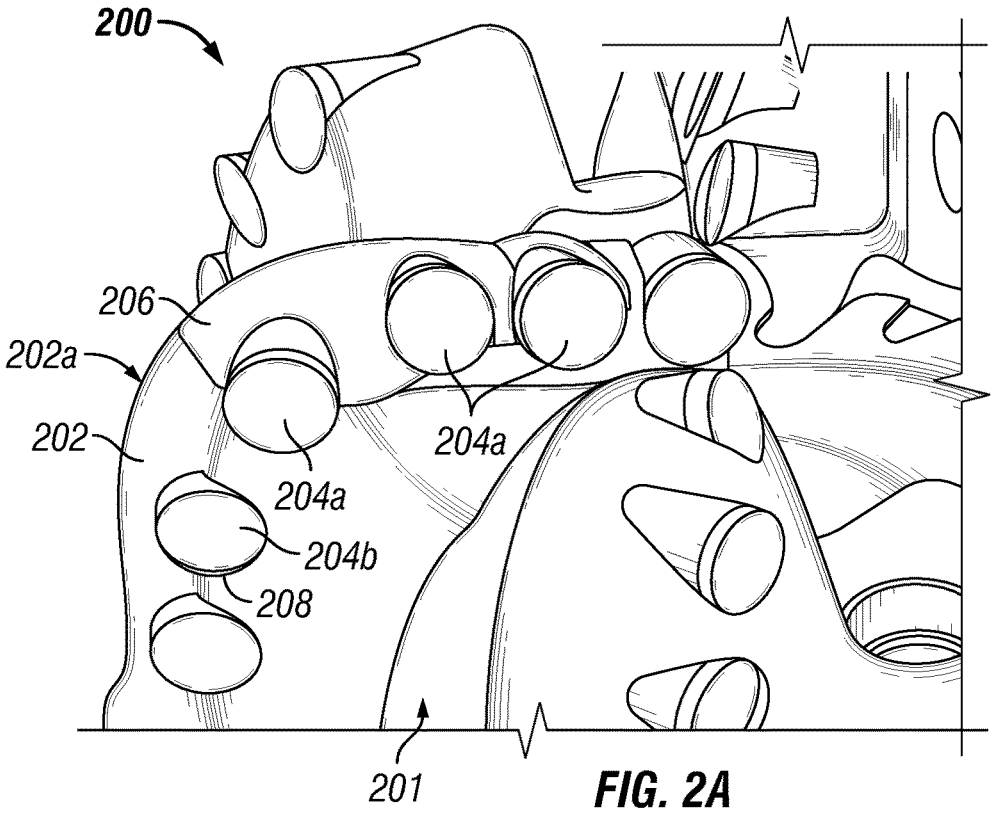
FIGS. 2A-D show various views of assembly of an embodiment of a retention component used to retain multiple cutting elements.
Figure 2B:
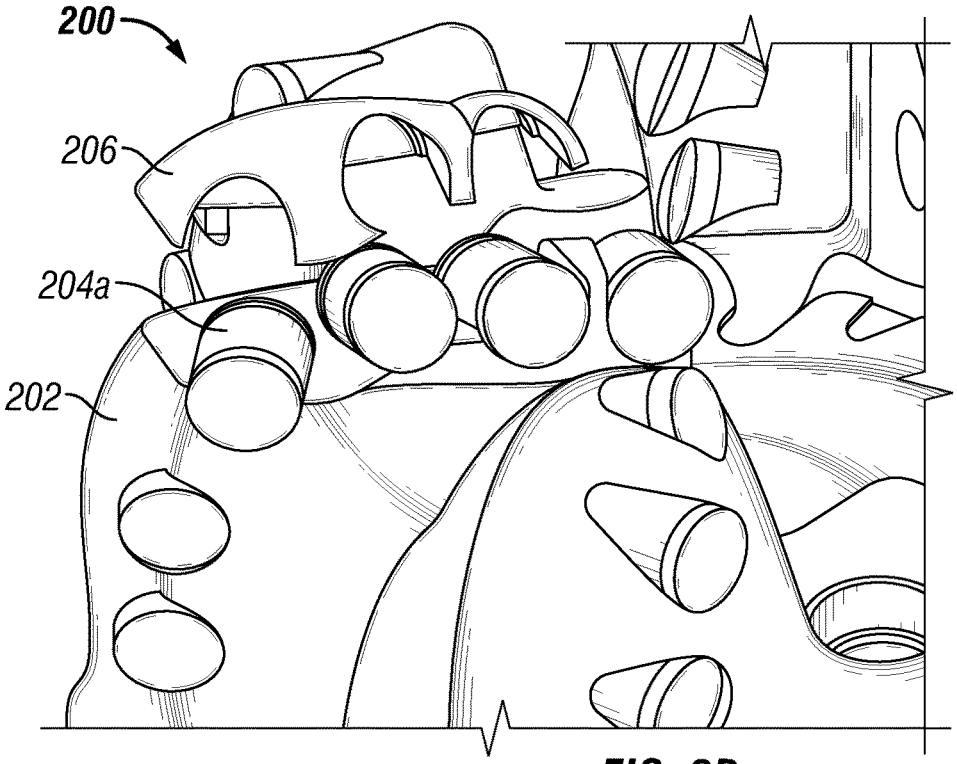

FIGS. 2A-D illustrates different assembled and disassembled views of multiple cutting elements being retained on a cutting element support structure (which may be a blade, for example, on a fixed cutter drill bit) by a single retention component. As shown in FIG. 2A, a drill bit 200 may include at least one blade 202 having a plurality of cutting elements 204 thereon. Cutting elements 204 may include cutting elements 204*a* retained on blade 202 by retention component 206 and cutting elements 204*b* retained on blade 202 by conventional brazing the cutting element 204*b* in a cutter pocket 208. As shown in FIGS. 2A and 2B, retention component 206 interfaces three cutting elements 204*a* along at least a portion of a side surface thereof of each cutting element 204*a*. While the embodiment shown in FIG. 2A-B shows retention of three cutting elements 204*a*, the present disclosure may also cover retention of two cutting elements or more than three cutting elements. In the embodiment shown in FIG. 2A-B, the retention component 206 (shown in more detail in FIG. 2C) has forms a portion of the blade top 202*a*, i.e., the top surface of blade 202 which is axially furthest surface from the bit body 201 from which the blade 202 extends. Retention component 206, serving as a blade top, may be cast in a mold to possess the desired shape of blade 202. In one or more other embodiments, the top portion of a blade 202 on a pre-formed bit 200 may be cut off, such as by wire EDM or other cutting methods, to separate the top and bottom sections of a blade and form retention component 206. The retention component 206 may be secured to the bit body 201 by brazing, welding, or mechanical locking, such as using threaded fasteners. While the outer surface of retention component follows the geometry of blade 202, the under surface of retention component is shaped to interface with and retain cutting elements 204*a*. Further, in embodiments, retention component 206 does not only interface the side surface of cutting element 204*a*, but it also restricts axial movement of the cutting element 204*a* within the cavity defined by pocket 208 formed in blade 202 and the under surface 210 of retention component 206. Axial movement may be restricted through corresponding groove and protrusions between cutting elements 204*a* and retention component 206 (and or pocket 208). In the embodiment shown in FIG. 2C-2D, a circumferential groove 212 is provided in cutting element 204*a*, and a corresponding protrusion 214 is provided in both the cutter pocket 210 and the retention component 206. In one or more other embodiments, protrusion may be provided in one of (either) cutter pocket 210 and retention component 206. Further, it is also within the scope of the present disclosure that cutting element 204*a* may have a protrusion, and the cutter pocket 210 and/or retention component 206 may have a groove. Further, in the embodiment shown in FIGS. 2A-2D, the groove/protrusion extend around the entire circumference of cutting element 204*a*, which does enable cutting element 204*a* to be able to rotate about its axis. However, embodiments of the present disclosure may also extend to fixed cutting elements that are mechanically retained on a blade 202, but which do not rotate. In such an instance, a partial groove or protrusion on a cutting element 204*a* may allow for retention of the cutting element 204*a* (and limitation of axial movement) without rotation about the cutting element axis 204*a*. Thus, the present application covers mechanically retained and non-rotatable cutting elements as well as retention of rotatable cutting elements.

Figure 2C:
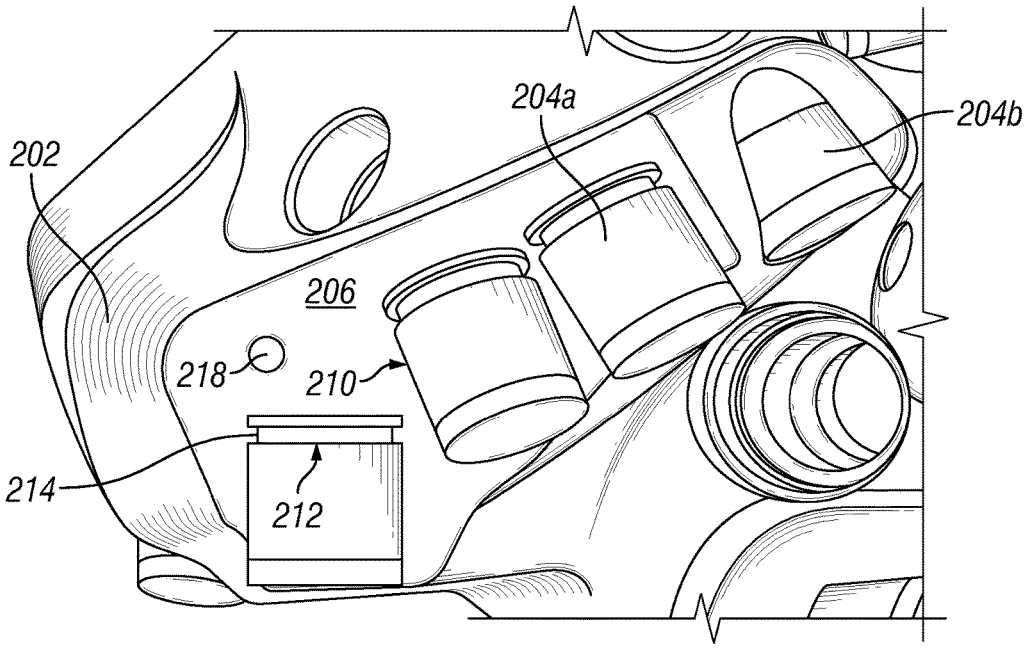
Figure 2D:
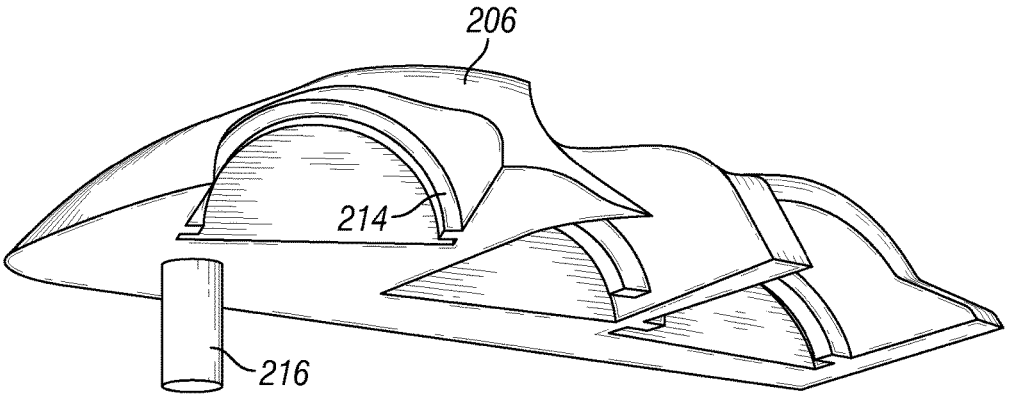

Referring now to FIGS. 2C and 2D, in some embodiments, the retention component may optionally include an alignment pin 216 and blade may include corresponding alignment pin hole 218, for ease in aligning the retention component 206 in placement with respect to the blade 202. If included, it may be desirable to include such feature rearward of the cutters 204*a* where there would be fewer interferences. Further, one of ordinary skill in the art would appreciate, upon reading the instant disclosure, that such alignment features need not be limited to the pin and corresponding hole shape, but may take any geometric configuration.

Figure 3A:
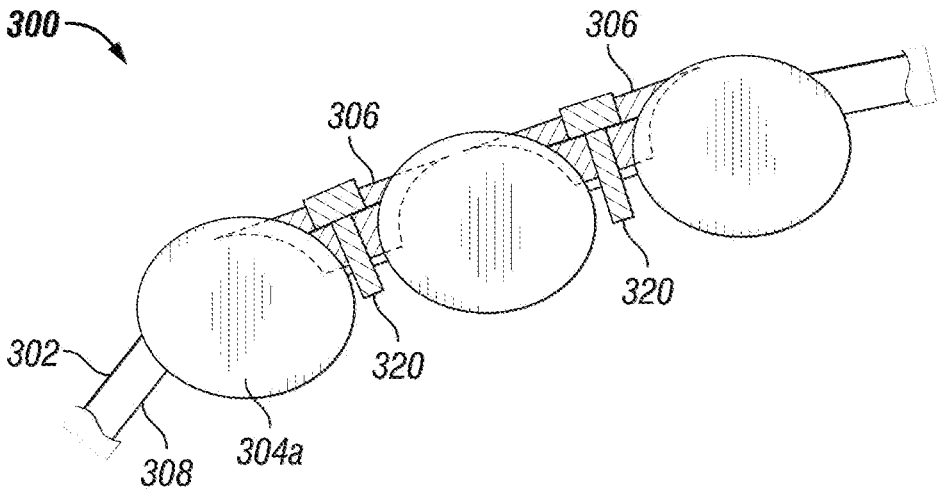
FIGS. 3A and 3B show a front view and a side, cross-sectional view of an embodiment of a retention component used to retain multiple cutting elements.
Figure 3B:
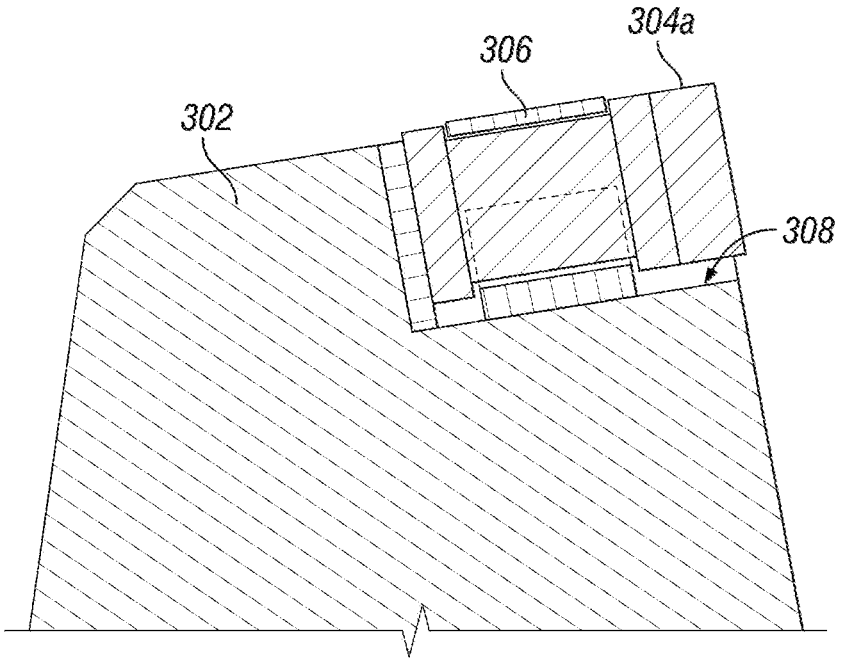

Referring now to FIGS. 3A-3B, another embodiment is shown. In the embodiment shown in FIGS. 3A-3B, a drill bit 300 may include at least one blade 302 having a plurality of cutting elements 304 thereon. Cutting elements 304 may include cutting elements 304*a* retained on blade 302 by retention component 306 and cutting elements (not shown) retained on blade 302 by conventional brazing the cutting element (not shown) in a cutter pocket 308. As shown in FIGS. 3A and 3B, retention component 306 interfaces a portion of the side surfaces of two cutting elements 304*a*. Specifically, in the embodiment shown in FIG. 3A-3B, retention component 306 extends laterally across a portion of a cutter diameter CD of two adjacent cutting elements 304*a* and axially downward in between the spacing of the two adjacent cutting elements 304*a*. In some embodiments, the retention component 306 may extend at least 0.2CD across a cutting element 304*a* and from 0.25CD to 0.5CD in another embodiment. Thus, retention component 306 may be referred to as a retention saddle, where a conventional saddle shape is essentially split in half and paired back to back together. Further, because retention component does not necessarily extend laterally over the entire (or substantially all) cutting element, two retention components may be needed to retain a cutting element 304*a*. However, it is also envisioned that a cutting element may be retained by a single retention component, depending on the extent of lateral coverage. For example, the retention component 306 may extend over the entire lateral extent of a plurality of cutting elements, similar to as shown in FIG. 2A-2D above, without the retention component necessarily taking the shape of a blade top. A retention bolt 320 retains retention component 306 on blade 302 and cutting element 304*a* thereon as well. In order to accommodate retention component 306 and retention bolt 320, cutter pocket 308 may have a lesser height, such as extending up to 0.5CD.

Further, referring to FIG. 3B, retention component 306 may limit the axial movement of the cutting element 304*a* by fitting within a groove 312 formed within the cutting element 304*a* side surface. Groove 312 may extend circumferentially around cutting element 304*a*, which may allow cutting element 304*a* to be rotatable about its own axis, or groove 312 may be non-circumferential and/or flat to prevent rotation in embodiments where the cutting element is to be mechanically retained without being rotatable. In the embodiment shown in FIG. 3B, the groove 312 extends along over one-half of the length of the cutting element substrate; however, other lengths may be used in other embodiments. In a particular embodiment, the groove may cover at least one-quarter of the length of the substrate, or for embodiments in which the entire cutting element is diamond (i.e., without a substrate attached thereto), the groove may cover at least one fifth the length of the substrate. Also shown in FIG. 3B is the optional inclusion of a thrust washer or disc 322 at the bottom surface of the cutting element 304*a* and a saddle bearing 324 being provided (optionally brazed in cutter pocket 308) to occupy the space between the groove 312 and the cutter pocket 308 and provide a bearing surface against which the cutting element 304*a* may rotate, in the case of a rotatable cutting element 304*a*.

Figure 4:
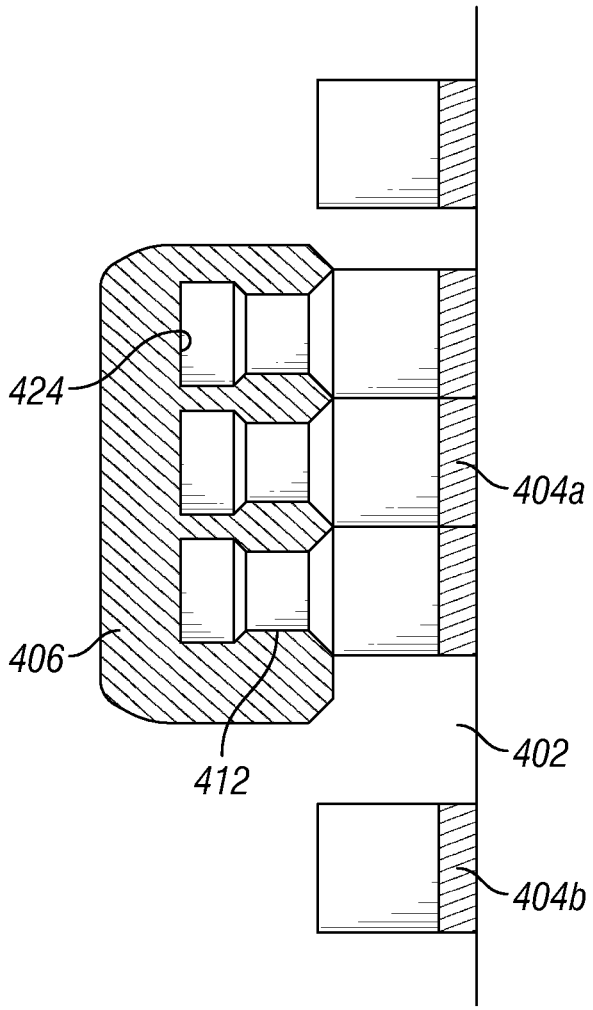
FIG. 4 shows a top, cross-sectional view of an embodiment of a retention component used to retain multiple cutting elements.

Referring now to FIG. 4, another embodiment of a retention mechanism retaining a plurality of cutting elements is shown. As shown in FIG. 4, a blade 402 may have a plurality of cutting elements 404 disposed thereon. Cutting elements 404 may be of two types: cutting elements 404*a* retained on blade 402 by a retention component 406 and conventional cutting elements 404*b* retained on blade 402 by brazing between the cutting element 404*b* and blade 402. In this embodiment, retention component 406 may be referred to as a cutter cartridge having a plurality of cutter cavities 424 formed therein in which a plurality of cutting elements 404*a* are disposed. Retention component 406 envelops the rear portion of cutting elements 406. In the embodiment shown in FIG. 4, cutting elements 404*a* have a groove 412 formed in a side surface thereof. Groove 412 may extend circumferentially around cutting element 404*a*, which may allow cutting element 404*a* to be rotatable about its own axis, or groove 412 may be non-circumferential and/or flat to prevent rotation in embodiments where the cutting element is to be mechanically retained without being rotatable. Cutter cartridge or retention component 406, specifically surfaces of cutter cavities 424, interfaces cutting elements 404*a* to limit axial movement of the cutting elements 404*a*. Cutter cartridge 406 may be brazed or mechanically attached to a blade 402. Cutter cartridge may allow for smaller spacing between cutting elements 404*a* than otherwise achievable when cutters are individually attached to a bit. For example, such spacing may be less than 0.1 inch (2.54 mm), or less than 0.08 inch (2.03 mm) or 0.05 inch (1.27 mm) in other embodiments. In fact, use of the cutter cartridge may also allow for two adjacent cutting elements 404*a* to have no gap therebetween, where the two cutting elements 404*a* are touching each other. Such embodiment may allow for increased cutter density to be placed on a blade, drill bit or other cutting tool.

Figure 5A:
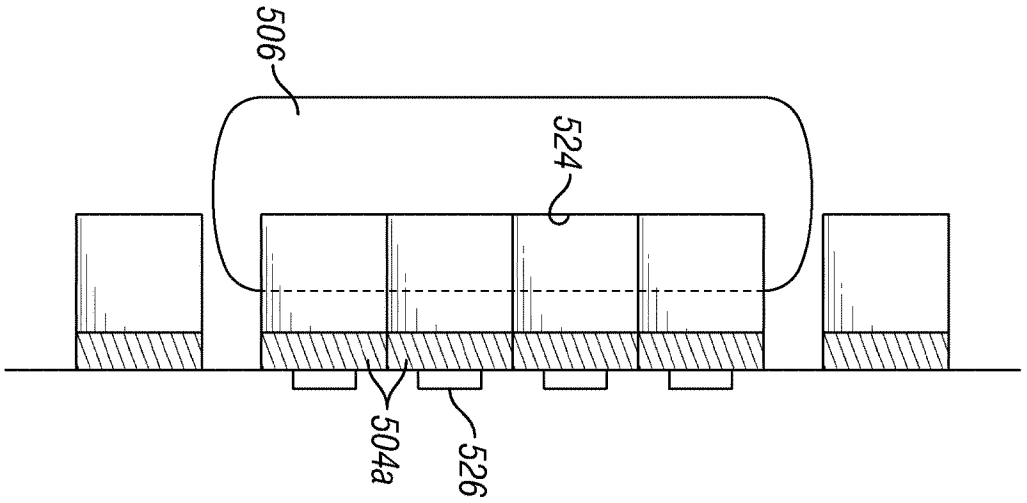
FIGS. 5A and 5B show a top, cross-sectional view and a front view of an embodiment of a retention component used to retain multiple cutting elements.
Figure 5B:
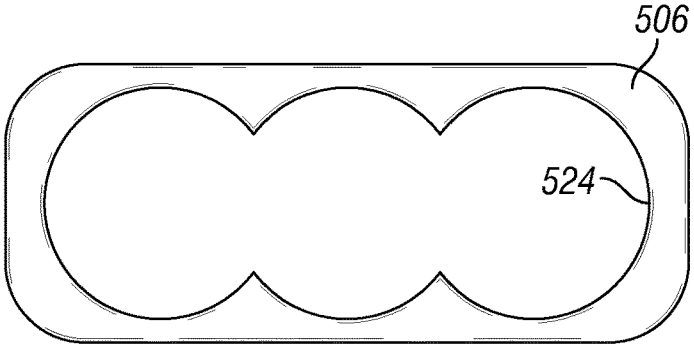
Figure 6:
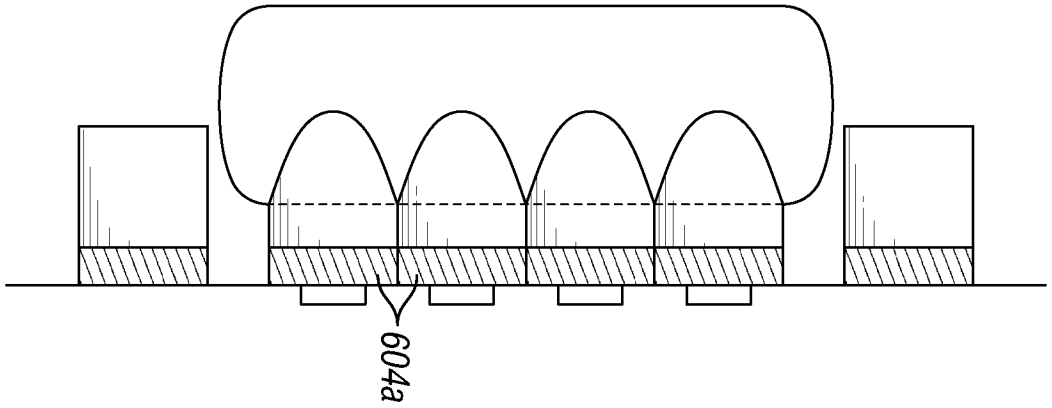
FIG. 6 shows a top, cross-sectional view of an embodiment of a retention component used to retain multiple cutting elements.

Referring now to FIGS. 5A and 5B, another embodiment using a cutter cartridge, similar to FIG. 4, is illustrated. As shown, cutting elements 504*a* are disposed in cutter cavities 524 in cutter cartridge 506 and are retained by cutter cartridge 506 (shown alone as a front view in FIG. 5B) as well as by front blocking element 526 that interfaces with a portion of a cutting face of cutting elements 504*a*. Thus, cutting elements 504*a* do not have a groove formed therein in the embodiment shown in FIG. 5A, but the cutter cartridge 506 limits radial movement of the cutting elements 504*a*. Further, another embodiment is shown in FIG. 6, in which cutting elements 604*a* are retained in the same manner as shown in FIG. 5, but in which the cutting elements 604*a* possess a rear conical surface, such as disclosed in U.S. Patent Publication No. 2012/0273280 A1.

The retention components used in any of the above-described embodiments may be formed from any wear resistant material, such as, for example, metal carbides, nitrides, or borides, tool steel, or the like. Size of each may be determined by the size of the cutters, bits, etc.

Further, in any of the above described embodiments that use multiple types of cutting element, it is also within the scope of the present disclosure that instead of conventional cutting elements brazed directly to a cutter pocket, one or more of such cutting elements may be replaced by cutting elements retained on a blade by other means, including rotatable cutting element or mechanically retained cutting elements, where such retention mechanism only retains a single cutting element.

Any of the above described embodiments may also include the use of diamond or carbide between interfacing surfaces of the rotatable cutting element and cutter pocket and/or retention component in which it is retained, such as shown in FIG. 3B. For example, diamond (or a similar material) may be incorporated on either the inner rotatable cutting element or the outer support element on any radial or axial bearing surface, or a separate diamond component may be used placed between the two components. For example, the bottom face of an inner rotatable cutting element or the shoulder of a sleeve may be formed of diamond or a similar material. Use of diamond on various bearing surfaces (integral with the cutting element components) is described in U.S. Pat. No. 7,703,559, which is assigned to the present assignee and herein incorporated by reference in its entirety. In one or more other embodiments, (and/or additionally), a separate diamond disc or washer may be placed adjacent a bottom face of the inner rotatable cutting element or adjacent the shoulder of a sleeve on which an inner rotatable cutting element rests.

Each of the embodiments described herein have at least one ultrahard material included therein. Such ultra hard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by removing substantially all metal from the interstitial spaces between interconnected diamond particles or from a diamond/silicon carbide composite, or other ultra hard material such as a cubic boron nitride. Further, in particular embodiments, the inner rotatable cutting element may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are generally found within the interstitial spaces in the diamond lattice structure. Cobalt has a substantially different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, such as hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Alternatively, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide, which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is optionally disposed may be formed of a variety of hard or ultra hard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the substrate may also be formed from a diamond ultra hard material such as polycrystalline diamond and thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be desirable to have a single diamond composite forming the cutting face and substrate or distinct layers. Specifically, in embodiments where the cutting element is a rotatable cutting element, the entire cutting element may be formed from an ultrahard material, including thermally stable diamond (formed, for example, by removing metal from the interstitial regions or by forming a diamond/silicon carbide composite).

It is also within the scope of the present disclosure that the blade and/or retention component (or any component interfacing the cutting element, particularly when the cutting element is rotatable) may also include more lubricious materials to reduce the coefficient of friction. The components may be formed of such materials in their entirely or have portions of the components including such lubricious materials deposited on the component, such as by chemical plating, chemical vapor deposition (CVD) including hollow cathode plasma enhanced CVD, physical vapor deposition, vacuum deposition, arc processes, or high velocity sprays). In a particular embodiment, a diamond-like coating may be deposited through CVD or hallow cathode plasma enhanced CVD, such as the type of coatings disclosed in US 2010/0108403, which is assigned to the present assignee and herein incorporated by reference in its entirety.

The cutting elements of the present disclosure may be incorporated in various types of cutting tools, including for example, as cutters in fixed cutter bits or hole enlargement tools such as reamers. Bits having the cutting elements of the present disclosure may include at least two cutting element retained by a single retention component with the remaining cutting elements being conventional cutting elements, all cutting elements being retained by the present disclosure, or any combination therebetween of presently retained and conventional cutting elements. In certain embodiments, bits having the cutting elements of the present disclosure may include at least two rotatable cutting element retained by a single retention component with the remaining cutting elements being conventional cutting elements, all cutting elements being rotatable retained by the present disclosure, or any combination therebetween of presently rotatable and/or retained and conventional cutting elements.

In some embodiments, the placement of the cutting elements on the blade of a fixed cutter bit or cone of a roller cone bit may be selected such that the rotatable cutting elements are placed in areas experiencing the greatest wear. For example, in a particular embodiment, rotatable cutting elements may be placed on the shoulder or nose area of a fixed cutter bit. Additionally, one of ordinary skill in the art would recognize that there exists no limitation on the sizes of the cutting elements of the present disclosure. For example, in various embodiments, the cutting elements may be formed in sizes including, but not limited to, 9 mm, 13 mm, 16 mm, and 19 mm.

Further, one of ordinary skill in the art would also appreciate that any of the design modifications as described above, including, for example, side rake, back rake, variations in geometry, surface alteration/etching, seals, bearings, material compositions, etc, may be included in various combinations not limited to those described above in the cutting elements of the present disclosure. In one embodiment, a cutter may have a side rake ranging from 0 to ±45 degrees. In another embodiment, a cutter may have a back rake ranging from about 5 to 35 degrees.

A cutter may be positioned on a blade with a selected back rake to assist in removing drill cuttings and increasing rate of penetration. A cutter disposed on a drill bit with side rake may be forced forward in a radial and tangential direction when the bit rotates. For embodiments involving a rotatable cutter, in some of such embodiments because the radial direction may assist the movement of inner rotatable cutting element relative to outer support element, such rotation may allow greater drill cuttings removal and provide an improved rate of penetration. One of ordinary skill in the art will realize that any back rake and side rake combination may be used with the cutting elements of the present disclosure to enhance rotatability and/or improve drilling efficiency.

For embodiments involving a rotatable cutter, as a cutting element contacts formation, the rotating motion of the cutting element may be continuous or discontinuous. For example, when the cutting element is mounted with a determined side rake and/or back rake, the cutting force may be generally pointed in one direction. Providing a directional cutting force may allow the cutting element to have a continuous rotating motion, further enhancing drilling efficiency.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A cutting tool comprising:

a tool body;

at least one blade extending radially from the tool body;

a plurality of cutters coupled to the at least one blade; and at least one retention component forming a portion of the at least one blade and contributing to retaining at least two of the plurality of cutters on the at least one blade, the at least one retention component forming at least a top portion of the at least one blade and having an outer surface following a geometry of the at least one blade and an under surface shaped to interface with and retain the at least two of the plurality of cutters.

2. The cutting tool of claim 1, the at least two cutters being rolling cutters that are rotatable about their axes when secured on the at least one blade.

3. The cutting tool of claim 1, the at least one retention component being positioned at a top surface of the at least one blade.

4. The cutting tool of claim 1, the retention component being welded to the blade.

5. The cutting tool of claim 1, the retention component being attached to the blade by threaded fasteners.

6. The cutting tool of claim 1, the retention component being brazed to the blade.

7. The cutting tool of claim 1, the retention component interfacing with side surfaces of the at least two of the plurality of cutters.

8. The cutting tool of claim 7, each of the plurality of cutters being positioned in a corresponding pocket on the at least one blade, and the retention component restricting axial movement of the at least two of the plurality of cutters within the corresponding pockets.

9. The cutting tool of claim 8, each cutter including at least one groove or protrusion formed in a side surface of the cutter, the at least one retention component interfacing the cutter along at least a portion of the groove or protrusion.

10. The cutting tool of claim 9, each pocket interfacing the cutter along at least a portion of the groove or protrusion.

11. The cutting tool of claim 1, the at least one retention component including at least one alignment pin, and the at least one blade including at least one alignment pin hole.

12. The cutting tool of claim 11, the at least one alignment pin and the at least one alignment pin hole being located rearward of the at least two of the plurality of cutters.

13. A downhole cutting tool, comprising:

a cutting element support structure having a blade with a plurality of cutter pockets formed therein;

a plurality of rotatable cutting elements coupled to the cutting element support structure, each of the plurality of rotatable cutting elements located within a corresponding pocket of the plurality of cutter pockets; and at least one retention mechanism retaining at least two of the plurality of rotatable cutting elements in corresponding cutter pockets, the at least one retention mechanism having an outer surface and an under surface, the outer surface having a geometry forming a top surface of the blade of the cutting element support structure and following a geometry of the at least one blade, and the under surface being shaped to interface with and retain the plurality of rotatable cutting elements.

14. The downhole cutting tool of claim 13, the at least two of the plurality of rotatable cutting elements having a groove in a side surface thereof, the at least one retention mechanism interfacing the grooves in the at least two of the plurality of rotatable cutting elements.

15. The downhole cutting tool of claim 14, the cutting element support structure interfacing the grooves in the at least two of the plurality of rotatable cutting elements.

16. The downhole cutting tool of claim 13, the at least one retention mechanism including a plurality of alignment pins rearward of the at least two of the plurality of rotatable cutting elements and which interface with a plurality of alignment pin holes in the cutting element support structure.

* * * * *